US006111511A

United States Patent [19]

Sivathanu et al.

[11] Patent Number: 6,111,511

[45] Date of Patent: Aug. 29, 2000

[54] FLAME AND SMOKE DETECTOR

[75] Inventors: Yudaya Sivathanu; Rony K. Joseph, both of West Lafayette, Ind.; Likeng Tseng, West Hills, Calif.; Jay P. Gore, West Lafayette; Andrew Lloyd, Bloomington, both of Ind.

[73] Assignee: Purdue Research Foundations, West Lafayette, Ind.

[21] Appl. No.: 09/009,054

[22] Filed: Jan. 20, 1998

[51] Int. Cl.[7] ..... G08B 17/12

[52] U.S. Cl. ..... 340/577; 340/578; 340/628; 340/629; 340/630; 250/338.1; 250/336.1; 250/339.01; 250/554

[58] Field of Search ..... 340/577, 578, 340/628, 629, 630; 250/339.05, 338.1, 554, 336.1, 339.01, 339.02, 339.08, 339.15, 340, 372

[56] References Cited

U.S. PATENT DOCUMENTS

| | | | |
|---|---|---|---|
| 3,940,753 | 2/1976 | Muller | 340/628 |
| 3,983,548 | 9/1976 | Tufts | 340/578 |
| 4,260,984 | 4/1981 | Honma | 340/630 |
| 4,533,834 | 8/1985 | McCormack | 250/554 |
| 4,671,362 | 6/1987 | Odashima | 169/61 |
| 4,675,661 | 6/1987 | Ishii | 340/630 |
| 4,857,895 | 8/1989 | Kaprelian | 340/630 |
| 5,073,769 | 12/1991 | Kompelien | 340/578 |
| 5,107,128 | 4/1992 | Davall et al. | 250/554 |
| 5,245,496 | 9/1993 | Cabalfin | 250/554 |
| 5,400,014 | 3/1995 | Behlke et al. | 340/630 |
| 5,625,342 | 4/1997 | Hall et al. | 340/578 |
| 5,673,027 | 9/1997 | Morita | 340/630 |
| 5,691,699 | 11/1997 | Vane et al. | 340/578 |
| 5,705,988 | 1/1998 | McMaster | 340/628 |
| 5,751,216 | 5/1998 | Narumiya | 340/630 |
| 5,889,468 | 3/1999 | Banga | 340/628 |

*Primary Examiner*—Daniel J. Wu
*Assistant Examiner*—Toan Pham
*Attorney, Agent, or Firm*—Jeffrey H. Canfiel; Laff Whitesel & Saret, Inc.

[57] ABSTRACT

A fire and smoke detector utilizes a statistical analysis of the near infrared radiation incident on it. The spectral radiation intensities incident on the fire detector are continuously measured at two near-infrared wavelengths, and a time series of apparent source temperatures is obtained from these measurements. The power spectral density and the probability density function of the apparent source temperatures are sufficient to determine the presence of a fire in the vicinity of the detector. The detector can indicate the presence of a fire in an adjoining room from the radiation which is incident on it due to reflections from common building materials. The present invention relates to fire and/or smoke detection methodology and associated apparatus. The detector utilizes fiber optic as a viewing and absorption/scattering detection means.

19 Claims, 10 Drawing Sheets

FLAME AND SMOKE DETECTOR

FIELD OF INVENTION

The present invention relates to fire and smoke detection methodology and associated apparatus.

BACKGROUND OF THE INVENTION

Conventional smoke sensors utilize light scattering or smoke ionization measurements, while conventional temperature sensors used in fire detection utilize thermocouple measurements. There are at least three disadvantages with conventional single sensor fire detectors: (1) there is a significant time delay between the start of the fire, and the transport of either combustion products or smoke to positions close enough to the detector to enable detection; (2) in instances when fire occurs in or at impermeable barriers (such as smoldering inside walls), the fire cannot be easily detected even in advanced stages of burning; and (3) single sensor detectors involve a high rate of false alarms due to any number of conditional changes in the operating environment, such as dust caused by vacuuming or smoke from burnt food, etc.

Combinations of smoke sensors and odor sensors which involve multiple fire signatures are less prone to false alarms (Okayama YU., Ito, T. and Sasaki, T., "Design of Neural Net to Detect Early Stages of Fire and Evaluation By Using Real Sensors' Data," *In Proc.* $4^{th}$ *Int. Symp. On Fire Safety Science*, 1994, pp. 751–9). However, multiple sensors involve greater construction cost and increased complexity of signal processing hardware and software.

More recently, there has been increased interest in the use of radiation emission sensors (flame detectors) as an alternative to smoke and heat sensors (*Middleton*, J. F., "Flame Detectors," $9^{th}$ *Int. Conf. On Automat. Fire Detection*, AUBE-89, Duisburg, Germany, 1989, pp. 143–54). The three major advantages of emission sensors are: (1) their ability to survey the entire room for fire initiation, (2) their fast response time, and (3) false signals can be readily distinguished since most fires are unsteady with unique frequency content, leading to unambiguous discrimination based on the power spectral density of the measured intensities (Grosshandler, W. L., "An Assessment of Technologies for Advanced Fire Detection," *Heat and Mass Transfer in Fire and Combustion Systems*, Vol. HTD-223, ASME, New York, 1992, pp. 1–9).

Single channel flame detectors operate either in the ultraviolet (where solar radiation is totally absorbed by the earth's atmosphere) or in the infrared (where flame emission is primarily from hot $CO_2$) parts of the spectrum. Ultraviolet signals from flames are normally very low leading to false alarms from indoor radiation sources such as incandescent lights, arc welding processes, etc. Therefore, ultraviolet flame sensors are limited to outdoor usage where interfering solar radiation is absorbed by the earth's atmosphere. Another disadvantage of ultraviolet flame detectors is that even minute contamination of the optical windows causes a significant loss of sensitivity.

Therefore, infrared flame detectors are used for large indoor areas such as aircraft hangars and warehouses where direct solar radiation is minimal. Single channel infrared detectors look for radiation emitted from hot $CO_2$ gases present in most flames at wavelengths around 2.7 $\mu$m or 4.4 $\mu$m. These single channel detectors must have precise bandpass optical filters in order to detect fires while successfully rejecting solar radiation. A corresponding problem with single channel detection is that since only one channel of information is present, the chances of false alarms are relatively high (*Middleton*, 1989; Okayama, et al. 1994).

False alarm problems present with single channel detection can be partially alleviated by using two channels of detection information. Typically two-channel flame detectors use one channel in the infra-red (typically at 4.4 $\mu$m) to detect hot combustion products. The second channel is chosen above or below the 4.4 $\mu$m band where there is a high level of solar radiation coupled with low levels of flame radiation. The addition of the second channel is purely for the prevention of false alarms by rejecting interference (such as direct solar radiation) from a continuum source that does not have the ubiquitous 4.4 $\mu$m $CO_2$ band. Fire is still detected using the 4.4 $\mu$m infrared channel, and in cases where fire is present along with the interfering source, it might be difficult to resolve the signal unambiguously (*Middleton*, 1989).

Conventionally, frequency analysis of radiation from flames is complicated for at least two reasons. (1) Most pool flames in a stable undisturbed pool have a characteristic flicker frequency associated with them. This characteristic frequency depends on the diameter of the pool. For example, a 5 cm flame pool might have a flicker frequency of 6.7 Hz and a 1 meter pool of the same material might have a flicker frequency of only 1.5 Hz. Therefore, the flicker frequency can vary from 1 Hz to 20 Hz in many fires. (2) For forced flames (such as those issuing from a burst pipe or oil well), it is very difficult to distinguish any flicker frequencies. In such an instance, the frequency spectrum can be very flat from 0 to 15 Hz with no discernible flicker frequency.

Apparatus for such a frequency analysis is mentioned by U.S. Pat. No. 5,594,421 to Thulliard. However, the analysis requires input data over a long period (typically 10 seconds) to obtain a "discernible" frequency component. Jet flames and smoldering flames cannot provide this component.

U.S. Pat. No. 4,665,390 to Kern, et al. looks at a probability density function (PDF) of specific radiation intensities and compares that factor with a factor obtained from a Gaussian noise factor. This analysis is not a frequency spectrum analysis (or a flame flicker frequency analysis). One should note that even bright sunlight can have a non-Gaussian PDF of intensities. In fact PDFs and frequency spectrums are two non-overlapping aspects of any signal, and U.S. Pat. No. 4,665,390 utilizes the mean and Kurtosis (which are moments of the PDF) that have no relation to the frequency spectrum. Moreover, many different signals have the same PDF but different power spectral densities (PSDs). For example, a sine wave at 10 Hz and another sine wave at 20 Hz have the same PDF but totally different PSDs.

It is noted that both the above detectors, in addition to requiring a wait-state, cannot detect smoldering fires and/or operate in locations with fire places.

Conventional techniques have long utilized fiber optic for the transmission of sensed information over distance. Such apparatus is shown by Kern et al. in U.S. Pat. No. 4,701,624 and 5,051,590.

SUMMARY OF INVENTION

The two most distinguishing characteristics of a natural flame are its apparent source temperature and the power spectral density of the radiation intensities emitted from it. Most accidental fires, with the exception of those in the methyl alcohol industry, are luminous because of small carbon particulate formed by most organic materials upon combustion. Research with such fires reveals the following.

Two-wavelength pyrometric measurements were conducted utilizing luminous pool and jet fires to reveal that the peak temperatures within these fires were in the range 1400±300 K. The power spectral density (PSD) of radiation fluctuations from natural fires exhibit a wide range of frequencies.

Based on these facts, one objective of the present invention is to set forth a near-infrared fire detector that is nearly impervious to false alarm.

One objective of the present invention relates to the fact that different signals can have the same PDFs as that of a fire (as mentioned in the above example, bright sunlight with some clouds, light reflecting off a body of water, etc.). This problem, inherent in the prior art can be eliminated if both the PDF and PSD of a temperature signal is studied in accordance with the claimed invention. The PDF is a measure of the amplitude alone while the PSD is a measure of how the amplitude of the signal varies in time. Therefore, having both is more advantageous since the signals such as the sunlight can be eliminated as set forth below in detail.

Another objective of the invention relates to an improved radiation viewing ability. Unlike conventional apparatus which is restricted to using fiber optic as a transmission medium, the present invention utilizes a novel multi-fiber optic fiber arrangement as an actual optical viewing means to significantly enlarge the viewing angle of detection.

Moreover, to meet an objective related to better and faster response time, the invention set forth and claimed herein operates in real time.

The novel detector is not restricted to conventionally waiting for flame flicker to occur to then evaluate the flicker at high frequencies—which with conventional apparatus may or may not meet "real world" fire situations. As set forth in detail hereinbelow, the present invention uses relatively low frequencies in the near infrared with two wavelengths closely spaced with narrow band filters to obtain an emission temperature. This novel ability, in conjunction with a probability density function utilized with a noise normalized power spectral density analysis, detects a flame in real time and discriminates it from other radiation sources.

As set forth in detail hereinbelow, the novel features of the present invention include:

(1) an integrated and noise normalized power spectrum analysis of radiation in the near infrared wavelength, that is responsive to a wide range of fires using a fixed sampling frequency and a fixed sampling time, and (2) utilization of two near-infrared wavelengths closely spaced with narrow bandpass optical filters to obtain a probability density function (PDF) of a source temperature.

These two novel provisions enable fire detection based on a firm statistical analysis of radiation signatures that is independent of the fire size or nature, ranging from smoldering cotton fires to high speed jet flames. In addition, the utilization of a fixed sampling frequency and time enables real time fire detection.

Still further, the present invention provides simultaneous smoke and flame detection in smoke filled enclosures. Such a novel feature enables use of the flame detector of the invention in rooms with fireplaces or other open flame appliances, and allows the utilization of the smoke detector of the invention in kitchens or aircraft cargo bays and other locations which are by their nature very dusty, smoky, humid, or otherwise exhibit an atmosphere laden with particulate.

These and other novel solutions to the long felt problems of the prior art, will be discussed in detail hereinbelow.

BRIEF DESCRIPTION OF THE DRAWINGS

A preferred embodiment of the invention is shown in the attached drawings in which:

FIG. 1 is a diagram of the geometry used to evaluate the NIR fire detector using reflected radiation;

FIG. 9 is an open side view of an assembled fire and smoke detector in accordance with the invention;

DESCRIPTION

The principle of operation of the near-infrared fire detector in accordance with the present invention relates to a novel two-wavelength optical pyrometer developed for determining soot volume fractions and temperatures in laboratory scale fires. The spectral radiation intensity emitted by a source at any wavelength, $\lambda$ is given by the equation of radiative transfer as:

$$I_\lambda = \epsilon_\lambda I_{\lambda,b} \tag{1}$$

where $I_{\lambda,b}$ is the blackbody intensity at the unknown source temperature T and $e_\lambda$ is its apparent spectral emissivity. The apparent spectral emissivity of particulate generated in fires burning organic material is inversely proportional to the wavelength.

For fire detection, the exact temperature and the emissivity of a flame source is usually not of great importance. Rather, the existence of any high temperatures in the vicinity of the detector is sufficient to indicate the presence of a fire. Therefore, the spectral emissivity of any radiation source (either direct or reflected) can be assumed to vary inversely with wavelength irrespective of its chemical composition, or the spectral reflectivity of intervening material.

Using this assumption, the apparent temperature of any source, determined from the measured spectral radiation intensities at two wavelengths can be defined as:

$$T = \frac{hc}{k}\left(\frac{1}{\lambda_1} - \frac{1}{\lambda_2}\right) \Big/ \ln\left\{\left[\frac{\lambda_2^6}{\lambda_1^6}\right]\left[\frac{I_{\lambda 1}}{I_{\lambda 2}}\right]\right\} \quad (2)$$

where h is Planck's constant, k is the Boltzmann constant, and c is the speed of light. The advantage of using two wavelengths close to one other is that the assumption of $1/\lambda$ dependence for the emissivity of the source does not seriously affect the apparent source temperature obtained using Eq. (2).

Figure 1:
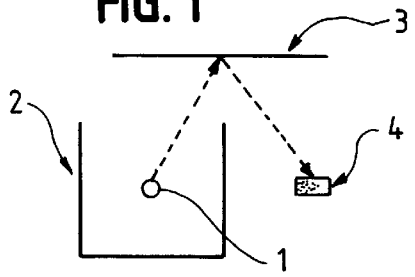
FIG. 1 a is a diagram of a NIR detector tested in accordance with the present invention.
Figure 1A:
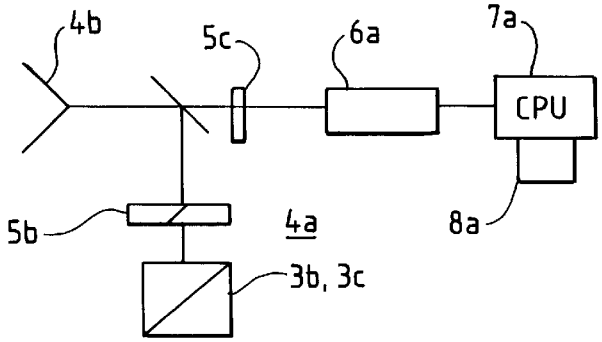

A schematic diagram of the near-infrared fire detector test apparatus is shown in FIG. 1*a*. The fire detector 4*a* consists of a 150° view angle reflector 4*b* that collects and collimates the radiation incident on it. The collimated radiation is split into two parts which are incident on two photo multiplier tubes (PMTs) 3*b*, 3*c* with narrow band pass filters 5*b*, 5*c* (10 nm FWHM) centered at 900 and 1000 nm in front of them.

The voltage outputs from the two PMTs 3*b*, 3*c* were monitored using an A/D board 6*a* and a laboratory computer 7*a*. These voltages were converted to spectral radiation intensities using calibration constants obtained using a standard reference blackbody (Infrared Industries) maintained at 1100K. From the spectral radiation intensities, a time series of apparent source temperatures was obtained using Eq. (2). This time series was statistically analyzed to determine an efficient method of distinguishing fires from background radiation such as sunlight, fluorescent and incandescent lamps (not shown).

Tests of fire detectors commonly used in residential and commercial buildings are typically conducted using six standard fires specified in the European Committee for Standardization (CEN, 1982) guidelines. To characterize the near infrared radiation emanating from natural fires, three of these six test fires were chosen for the present study.

Fire detectors commonly used in residential and commercial buildings are tested using several standard fires specified in the CEN guidelines. See CEN, "Components of Automatic Fire Detection Systems: Fire Sensitivity Test," Part 9, *European Committee for Standardization, Brussels* (1982). Three of the test fires were open luminous fires obtained from the burning of a wooden crib (designated TF1 in the CEN guidelines), a heptane pool (TF5) and polyurethane mats (TF4). Two of the test fires were smoldering combustion from cotton fibers (TF2) and wooden pellets (TF3). The five test fires, TF1 to TF5, were used to evaluate the operation of the near infrared fire detector of the invention when only reflected radiation is incident on it.

The test configuration used for the evaluation of the NIR fire detector of the invention using reflected radiation is shown in FIG. 1. Direct radiation from the test fires 1 is blocked using screens 2.

Only that portion of the radiation that is reflected from a poster board 3 is allowed to impinge on the detector 4. The reflectivity of the poster board 3 at 900 and 1000 nm is very low. Therefore, the spectral radiation intensities incident on the NIR fire detector 4 from the reflected radiation were an order of magnitude lower than those incident from direct radiation. In addition, the poster board 3 has different reflectivities at 900 and 1000 nm. Therefore, the ratio of the spectral radiation intensities at 900 and 1000 nm incident on the near infrared fire detector 4 changes. This causes either an increase or decrease in the apparent source temperatures calculated using Eq. 1.

Figure 2A:
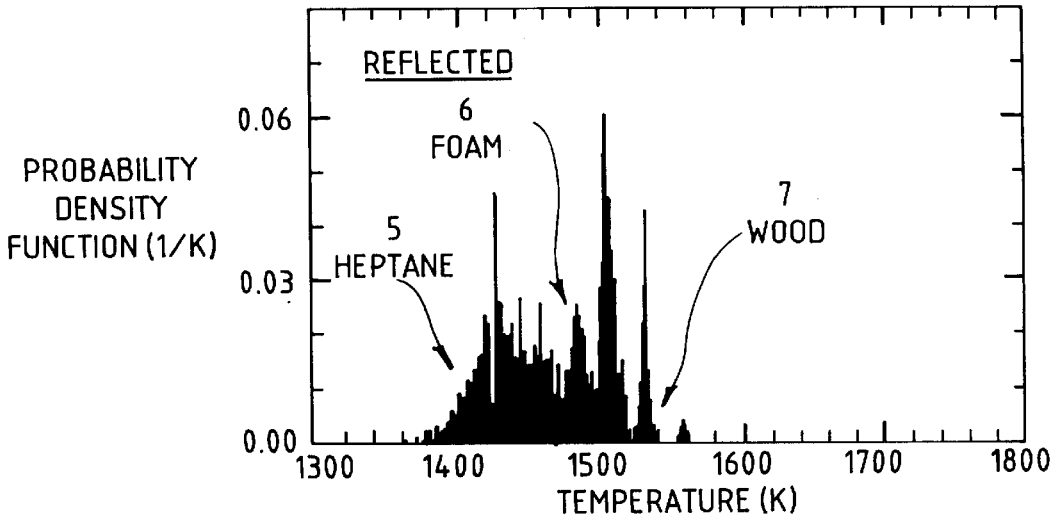
FIG. 2 shows a graph of the PDFs of apparent source temperatures for open fires.
Figure 2B:
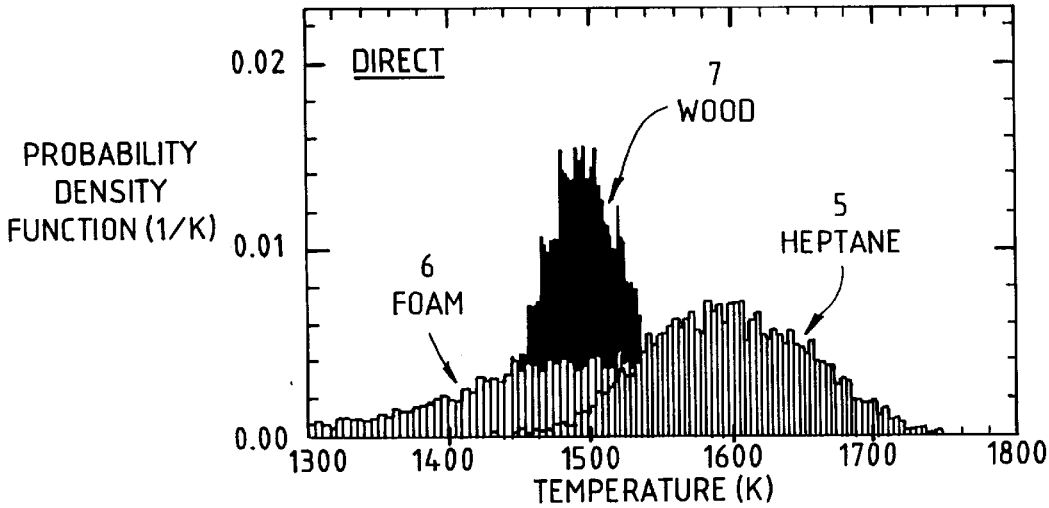

The probability density functions (PDFs) of apparent source temperatures estimated from measurements of direct and reflected spectral radiation intensities are shown in FIG. 2. The PDFs of apparent source temperatures obtained with the three open fires (heptane 5, foam 6, and wood 7) in the direct view of the detector 4 are shown in the bottom panel (B) of FIG. 2. The apparent source temperatures for the three open fires 5, 6, 7 range from 1300 to 1800 K.

The PDFs of apparent source temperatures for the three open fires 5, 6, 7 when only reflected radiation is incident on the detector 4 are shown in the top panel A of FIG. 2. For liquid pool fires, the higher temperatures are usually associated with very low soot volume fractions. Therefore, even at these higher temperatures, the spectral radiation intensities could be lower than those obtained at relatively lower temperatures. In addition, at the lowest range of temperatures, the spectral radiation intensities are also very low. Therefore, after one reflection, only the middle range of temperatures (with some spectral biasing) are detected by a conventional infrared fire detector (not shown).

The changes in the shape of the apparent source temperature PDFs could be due to a combination of factors, including spectral biasing of the reflected intensities, shape of the flame, and correlation between local temperatures and emissivities. In addition, the wood fire 7 is transient in nature, and the temperatures obtained from direct and reflected radiation could be at different stages in the development of the fire.

For the polyurethane foam fires 6, only the middle range of temperatures (in comparison with the direct tests) is detected from reflected radiation (similar to the heptane pool fires 5). Despite the differences in the PDFs obtained from the direct and indirect viewing of the fire, all of the temperatures fall within 1000 to 2000 K. This satisfies a first criterion for the existence of a fire in the vicinity of the detector 4 which states that at least 40% of the PDF of apparent source temperature should be between 700 and 2500 K. See Sivathanu, "Radiative Heat Transfer Inside a Cylindrical Enclosure with Nonparticipating Media Using A Deterministic Statistical Method," *Proceedings of the ASME Heat Transfer Division*, HTD-Vol. 332, pp. 145–152, ASME, New York (to be published, and herein incorporated by reference).

Figure 3A:
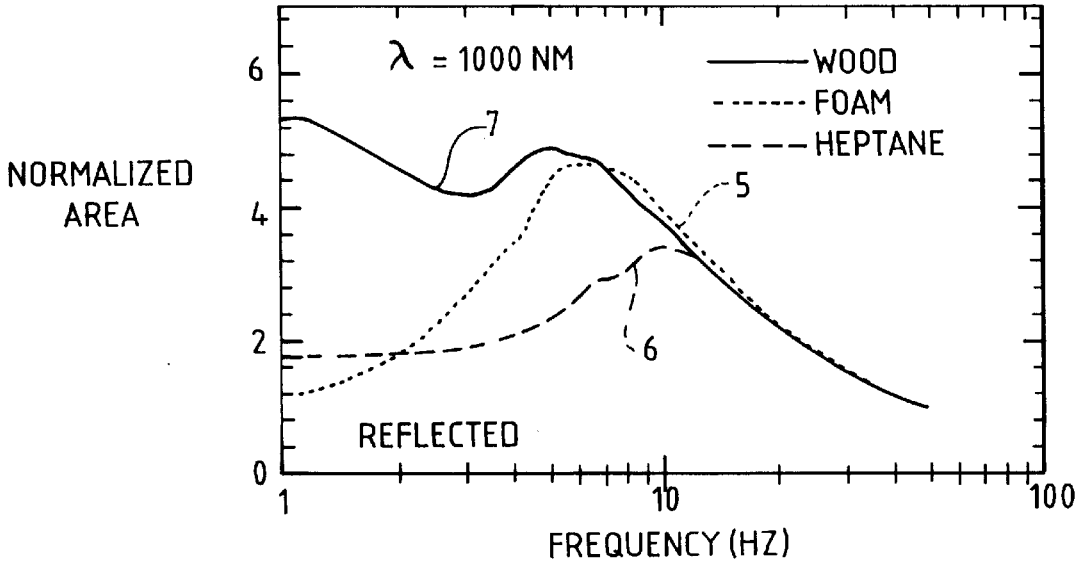
FIG. 3 shows a graph of normalized PSDs of spectral radiation intensities for open fires.
Figure 3B:
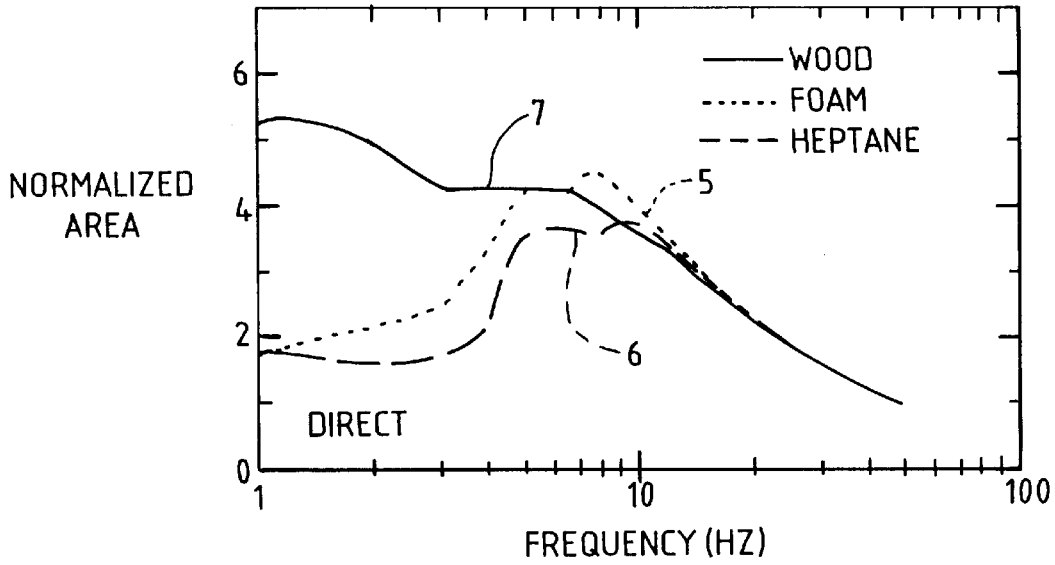

The second criterion that should be satisfied for the existence of a fire in the vicinity of the detector 4 is that the normalized power spectral density (PSD) of spectral radiation intensities at 10 Hz should be 1.5 higher than a random signal. The first condition is important to detect sources of high temperatures in the immediate vicinity of the fire detector. The second condition is important to eliminate ambiguous signals originating from natural and artificial sources such as incandescent and fluorescent lamps, solar radiation reflected from building materials, natural gas burners and electric hot plates (not shown). The normalized PSDs of spectral radiation intensity at 1000 nm for the three open fires are shown in FIG. 3. The normalized PSDs obtained from reflected and direct radiation are shown in the top (A) and bottom panels (B) respectively of FIG. 3.

Figure 4A:
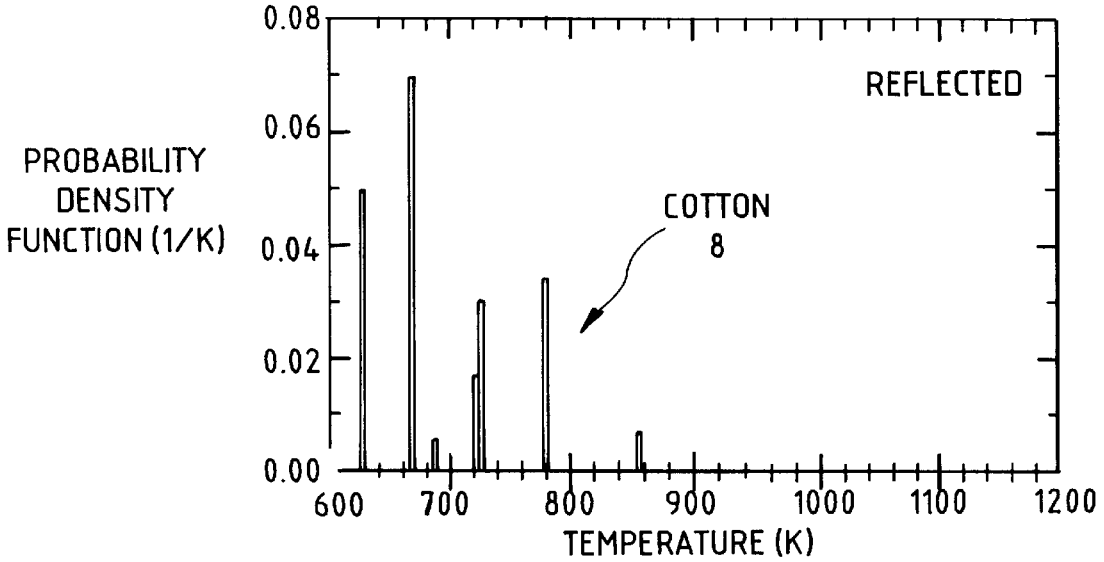
FIG. 4 shows a graph of PDFs of apparent source temperatures for smoldering fires.
Figure 4B:
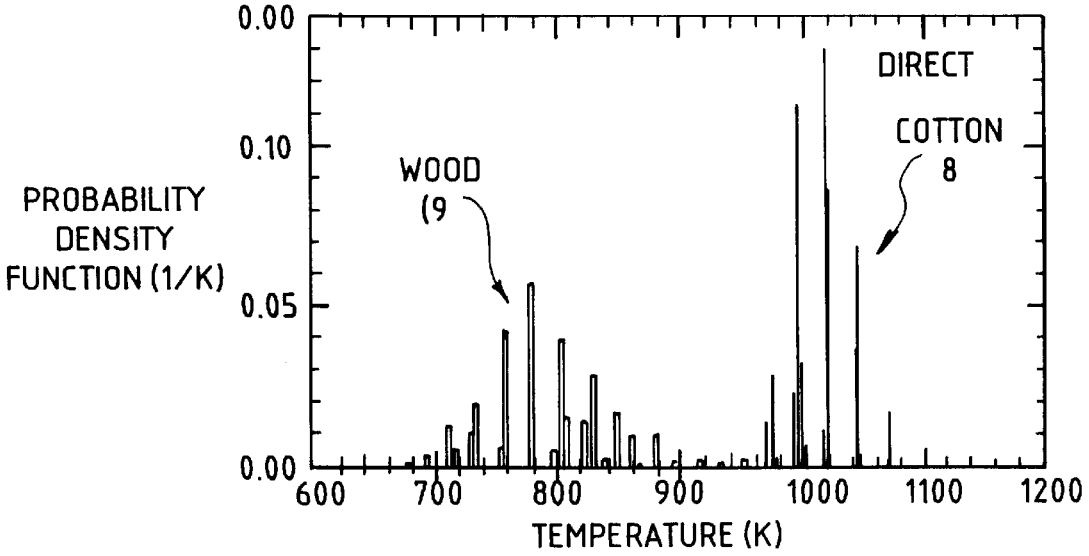

In both cases, the total energy of the fluctuations below 10 Hz is 1.5 times greater than that from white noise, satisfying the second criteria for the presence of a fire in the vicinity of the detector 4. The PDFs of apparent source temperatures for the smoldering fires (cotton fiber 8 and wooden pellets 9) are shown in FIG. 4. Smoldering fires have much lower temperatures than open fires.

The PDFs of apparent source temperatures obtained from direct radiation for the smoldering cotton fire 8 varies from 900 to 1100 K, and that for the smoldering wood fire 9 varies from 700 to 900 K, as shown in the bottom panel of FIG. 4. The PDF of apparent source temperatures obtained using reflected radiation from the smoldering cotton fire 8 is approximately 200 K lower. In addition, the PDF is not continuous. This is because the reflected intensities incident on the NIR fire detector from the smoldering cotton fire 8 are very low. For the smoldering wood fire 9, the reflected intensities were below the detection threshold of the NIR fire detector 4.

Figure 5:
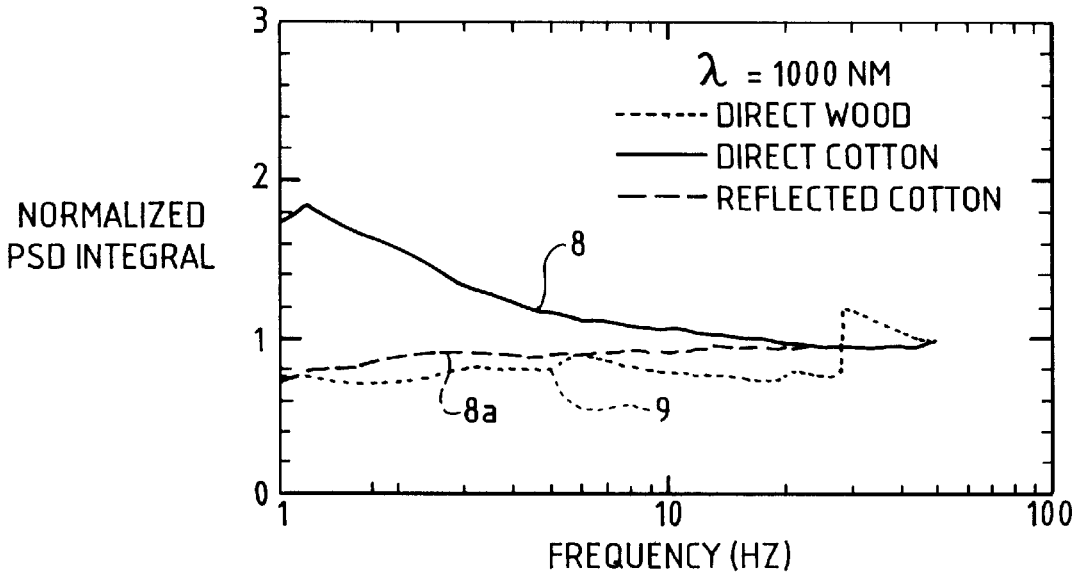
FIG. 5 shows a graph of normalized PSDs of spectral radiation intensity at 1000 nm for smoldering fires.

The normalized PSDs of spectral radiation intensities at 1000 nm for the two smoldering fires are shown in FIG. 5. The intensities obtained from the direct view of the smoldering wood fire 9 and from the reflected view of the cotton fire 8*a* are barely above the noise level, and therefore could not be identified by the near infrared fire detector 4 as valid fire signals.

The major reason for the very poor performance with the smoldering wood fire 9 is that the smolder surface is face down on the burner (not shown) and therefore very little of the smoldering surface is visible. A standard test fire (TF3) is typically designed to test smoke detectors and not flame detectors. See CEN, "Components of Automatic Fire Detection Systems: Fire Sensitivity Test," Part 9, *European Committee for Standardization*, Brussels (1982). For flame detection, an alternative standard test for smoldering wood would be more appropriate. The intensities obtained from reflected radiation at 900 and 1000 mn are an order of magnitude lower than those obtained from direct radiation.

Therefore, conventional fire detection algorithms (based on the absolute magnitude of intensities), which have to account for this variation, typically result either in decreased sensitivity or lower immunity to false alarms. The PDFs of apparent source temperatures obtained from the reflected radiation are shifted to higher values.

Numerical evaluation of the near infrared fire detector 4 was conducted using a photon tracing algorithm in conjunction with the discrete probability function (DPF) method. See "Radiative Heat Transfer Inside a Cylindrical Enclosure with Nonparticpating Media Using A Deterministic Statistical Method," Proceedings of the ASME Heat Transfer Division, HTD-Vol 332, PP. 145–152, ASME, New York. The simulations were performed for axisymmetric and rectangular enclosures. The axisymmetric simulations were carried out for a cylindrical enclosure with aspect (length to radius) ratio of 3. See "Radiative Heat Transfer Inside a Cylindrical Enclosure with Nonparticipating Media Using A Deterministic Statistical Method," *Proceedings of the ASME Heat Transfer Division*, HTD-Vol 332, PP. 145–152, ASME, New York.

The geometry used for the three dimensional simulations is described below and shown in FIG. 6. A three dimensional rectangular enclosure 60 of length L, and width and height a, has a heptane pool fire 5 at one end. The angular distribution of spectral radiation intensities emanating from a standard heptane pool fire 5 was measured and used as a radiation source for the simulations.

Figure 6:
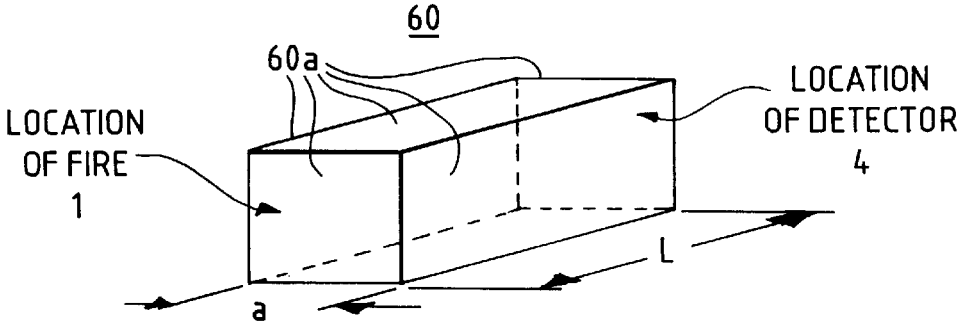
FIG. 6 is a diagram showing the geometry used for numerical evaluation of the fire detector of the invention.

A detector 4 is placed at the other end as shown in FIG. 6. Part of the radiation emitted by the blackbody is absorbed by the walls 60*a* of the enclosure 60, and the remainder reflected. The absorptivity of the walls 60*a* also changes with wavelength. The reflectivity of the walls 60*a* of the enclosure 60 has both a specular and diffuse component. The effect of the interaction of the photons with the walls 60*a* of the enclosure 60 on the temperatures estimated by the NIR fire detector 4 are calculated using a photon tracing algorithm as set forth in detail in "Radiative Heat Transfer Inside a Cylindrical Enclosure with Nonparticipating Media Using A Deterministic Statistical Method," *Proceedings of the ASME Heat Transfer Division*, HTD-Vol 332, PP. 145–152, ASME, New York.

In the photon-tracing algorithm, photons of different wavelengths representing the heptane fires 5 are launched into the enclosure 60 at various angles, also representing the heptane fires 5. An individual photon strikes a surface 60*a* of the enclosure 60 depending on this angle of launch. At the surface 60*a*, the photon is either absorbed or reflected based on a probability assigned by the surface reflectivity to each of these events. Further, the photon may be reflected at the same angle as that of the incidence or may be reflected at a random angle also based on probabilities assigned by the surface reflection properties. Finally, the photons incident on the detector 4 are absorbed and contribute to the radiation intensity signal. In the calculation procedure, over 10,000 photons are launched and the intensity measured by the detector 4 is equated to the fraction of these photons hitting the detector 4 times the intensity of the fire 5.

The accuracy of the calculations were confirmed by comparison with analytical results that are available for limiting cases. See "Radiative Heat Transfer Inside a Cylindrical Enclosure with Nonparticipating Media Using A Deterministic Statistical Method," *Proceedings of the ASME Heat Transfer Division*, HTD-Vol 332, PP. 145–152, ASME, New York. For example, when the reflectivity is set to zero, the fraction of photons that reach the detectors 4 is just the view factor, and the estimated temperature obtained for a 1500 K blackbody source remains unchanged. In addition, when the reflectivity and the specularity were set to one, all the photons reach the detector 4 with no spectral biasing, and the estimated temperature is again 1500 K.

Figure 7:
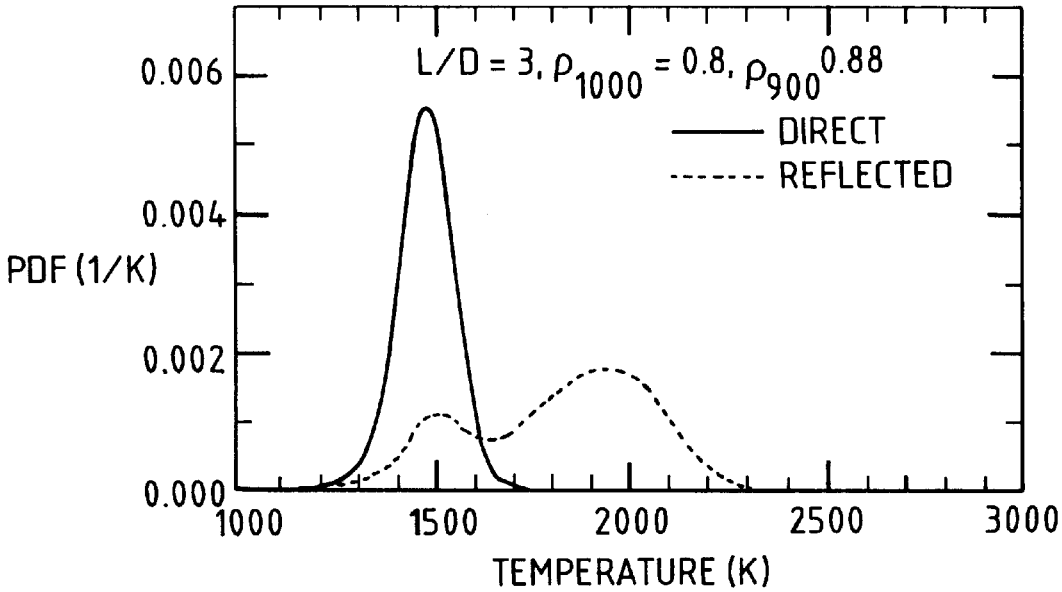
FIG. 7 shows a graph of the effect of reflections on the apparent temperatures estimated by the present invention.

The PDFs of apparent source temperatures for an axisymmetric enclosure (not shown) with and without considering reflections from the walls of the enclosure are depicted in FIG. 7. The aspect (length to radius) ratio of the enclosure was 3. The walls of the enclosure were assumed to have reflectivities of 0.8 and 0.88 for the 1000 nm and 900 nm radiation respectively. The specularity of the reflection was assumed to be 0.4.

The PDFs of source temperatures with and without considering the reflected photons from the walls of the enclosure are shown by the dotted and solid line in FIG. 7 respectively. A fraction of photons was directly incident on the detector 4 without undergoing any reflections from the wall. Therefore, the apparent source temperatures obtained from these direct photons were not changed. The effect of the reflections is to increase the apparent source temperatures inferred by the NIR fire detector 4 since the longer wavelength photons are preferentially absorbed. Therefore, the PDF of apparent source temperatures obtained taking the reflected photons into account has a bimodal behavior. Despite the higher values for the estimated source temperatures, the NIR fire detector 4 could successfully discriminate the fires from background radiation, since most of the temperatures are still within 800 to 2500 K.

The PSDs of intensities do not vary with reflections in the simulation (as well as in ideal experiments) since the time taken by the photons to undergo multiple reflections with a wall 60*a* is much lower than the smallest time scales present in the flow.

Figure 8:
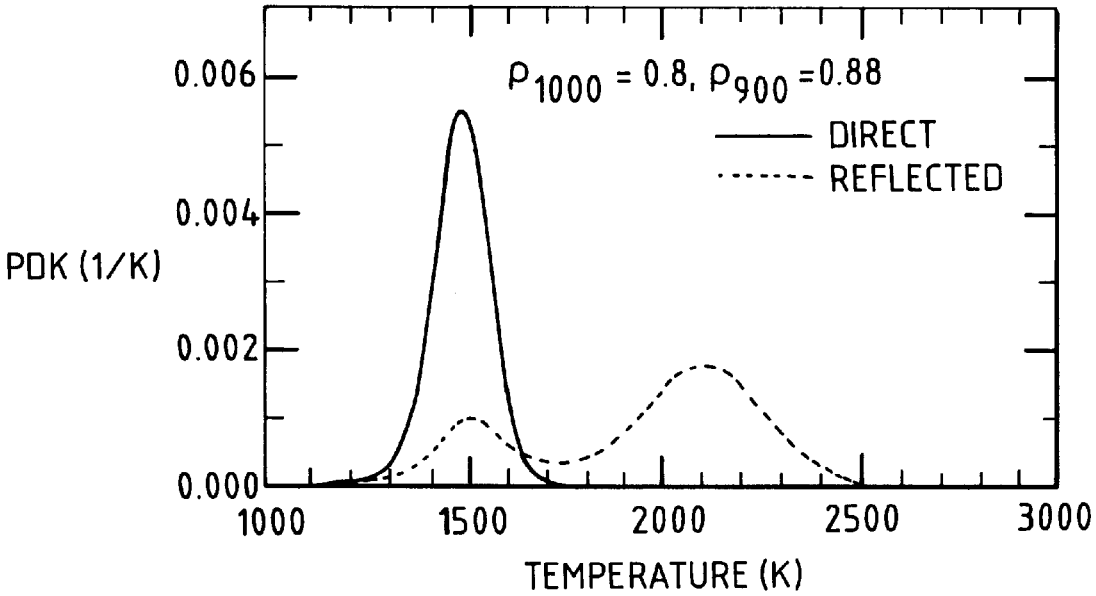
FIG. 8 shows a graph of the effect of reflection on the apparent temperatures inferred by the detector of the claimed invention.

The effect of wall 60*a* reflections on the PDF of apparent source temperatures for the rectangular enclosure 60 is shown in FIG. 8. Similar to the axisymmemtric case, the walls 60*a* of the enclosure 60 were assumed to absorb 20% of the photons at 1000 nm , and 12% of the photons at 900 nm. The specularity of the reflectivity was also set at 0.4.

Similar to the results of the axisymrnmetric enclosure, the preferential absorption of the longer wavelengths leads to an increase in the apparent source temperatures (shown by the dotted line in FIG. 8). In addition, the combination of direct and reflected photons result in a bimodal PDF for the apparent source temperatures. Despite the changes in the PDF caused by the reflections, the range of temperatures still satisfy the criteria for the presence of a fire in the vicinity of the detector 4. See "Fire Detection Using Time Series Analysis of Source Temperatures," *Fire Safety Journal*, January 1998, Vol. 29, pp. 301–315; "Fire Detection Systems: Fire Sensitivity Test," Part 9, *European Committee for Standardization*, Brussels (1982).

Two major conclusions obtained from this experimental evaluation of the NIR fire detector 4 are: (1) open fires can be detected with very low false alarm rates even when the fire 1 is not in the direct view of the detector 4, and (2) smoldering fires can be detected when the fire 1 is in direct view of the detector 4. The major conclusion obtained from this numerical work is that the performance of the NIR fire detector 4, even with significant spectral biasing for radiation reflected from building materials, is novel and very beneficial.

A near-infrared fire detector which operates on the principle of apparent source temperatures obtained from spectral radiation intensity measurements at two near-infrared wavelengths has been described in theory. A detection algorithm is provided that is capable of indicating the presence of fire in the vicinity of the detector based on a probability density function and power spectral density analysis of apparent source temperatures. The novel detector is also effective for detecting many fires that are not in its direct view and that may occur in the presence of interference from natural and artificial sources.

We turn now to a detailed description of a preferred embodiment of the present invention. The following description should be read in conjunction with FIGS. 9–12. In both residential and automotive applications, detector 900 may provide output to a selected alarm device (901) including one that may play audio instructions, an electronic security system, an automated telephone, or to a fire suppression system such as sprinklers. The fire suppression systems may also include automated actuation devices such as squib actuated bottles (not shown). The sensitivity and range of the device, background tolerances, and even the process for detection and false signal discrimination in the two applications can be customized by programming.

Figure 9A:
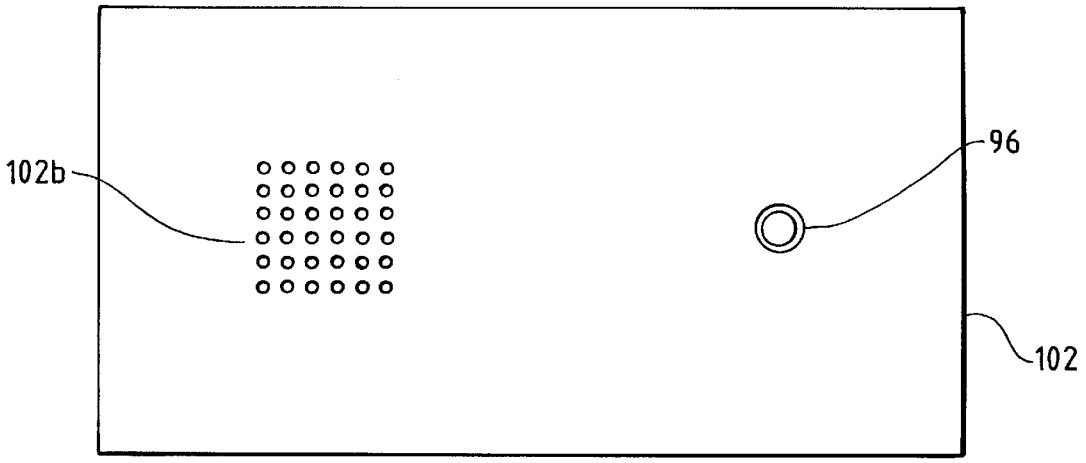
FIG. 9*a* is a top view of the fire and smoke detector of FIG. 9.
Figure 9B:
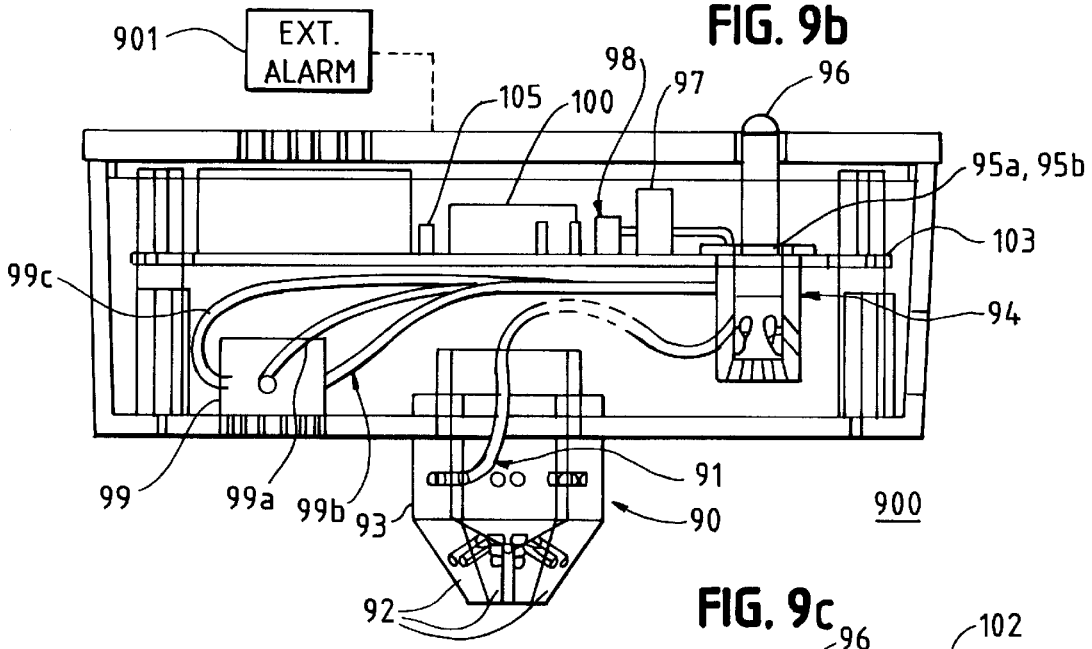
FIG. 9*b*–9*c* are end views of the fire and smoke detector of FIG. 9.
Figure 9C:
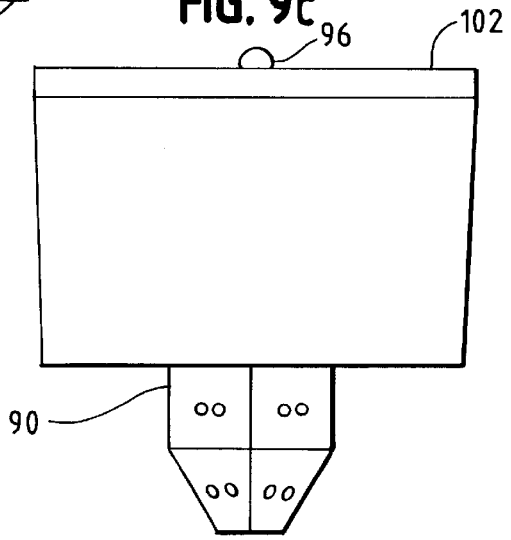
Figure 10:
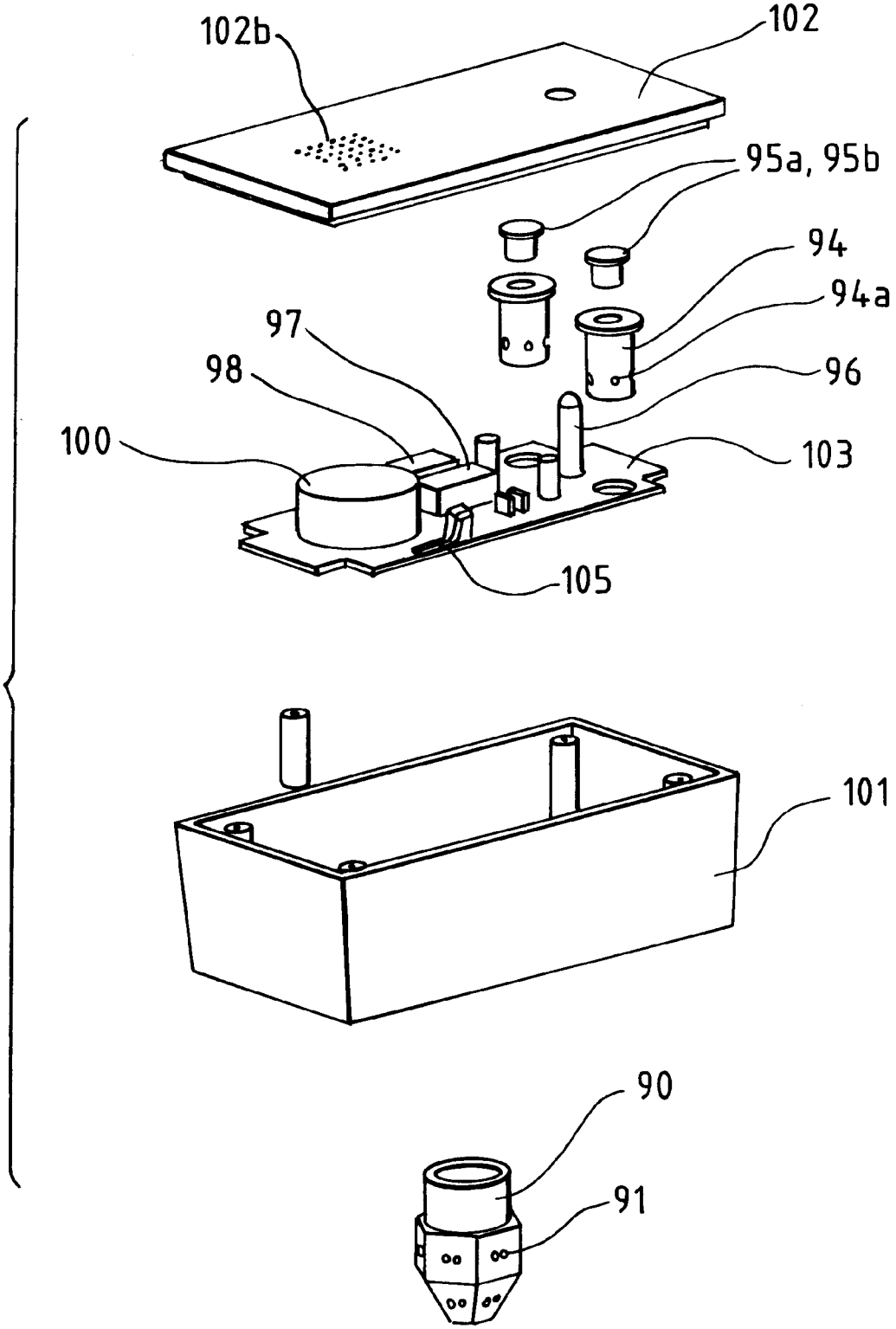
FIG. 10 is an exploded perspective view of the components of the detector of FIG. 9.
Figure 12:
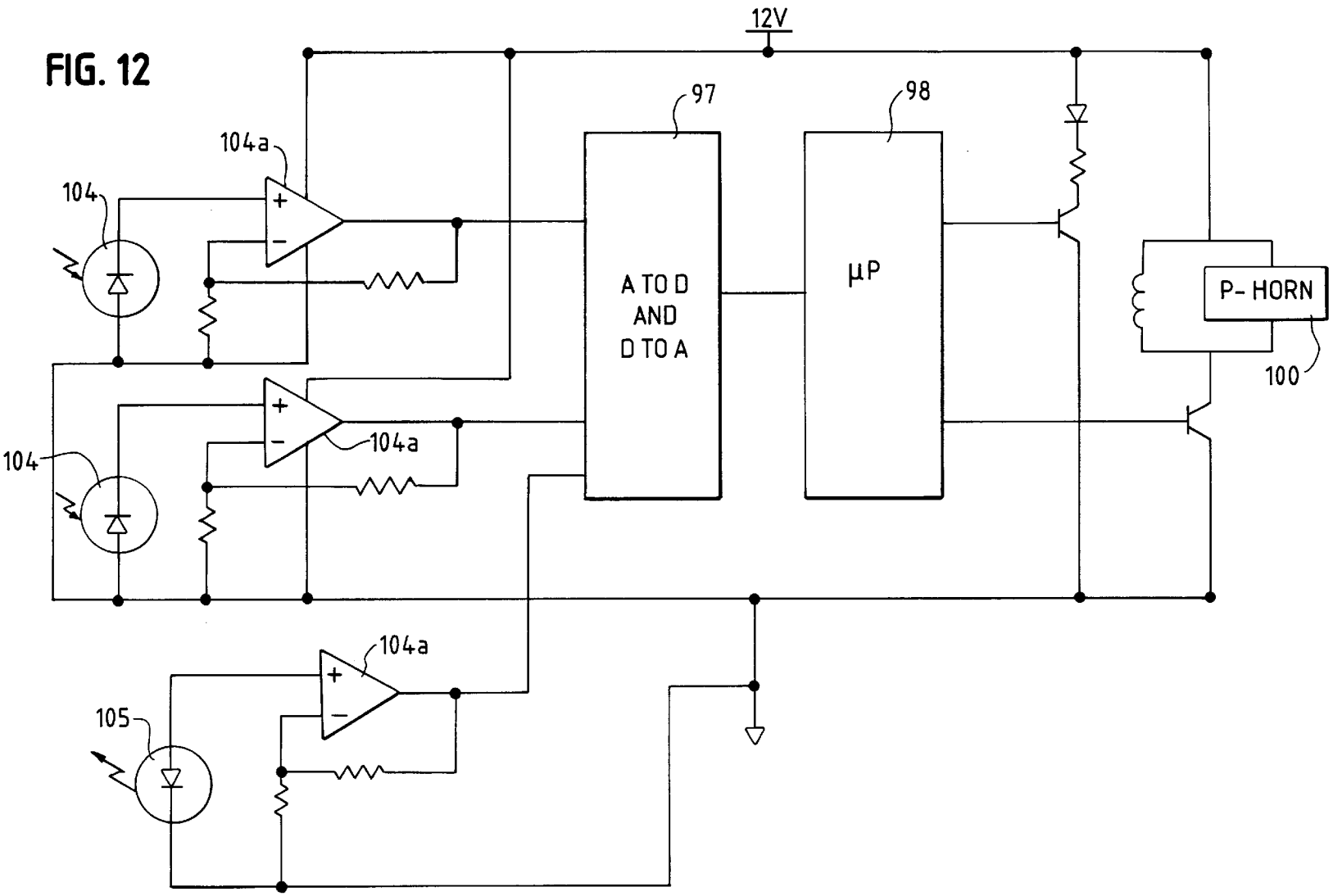
FIG. 12 is a schematic circuit drawing of the preferred embodiment of the invention.

FIG. 9 shows an assembly of the entire invention. FIG. 10 shows details of the assembled parts. FIG. 12 shows the electronic components. The detector 900 includes a flame detection unit 90 and a smoke detection unit 99. The flame detection unit 90 has a wide view angle (at least 270 degrees and can approach 360 degrees) afforded by fiber optic doublets 91 mounted on multiple viewing faces 92 of a viewing head 93. Each member of the fiber optic doublet 91 carries radiation from the room (not shown) into a multi-fiber connector 94. The multi-fiber connector 94 has a reflective inner surface or a receptacle (not shown) to direct all incoming radiation carried into it on to the near infrared photo-detectors 95*a*, 95*b*. The photo-detectors 95*a*, 95*b* are equipped with narrow band optical filters (not shown) at two closely spaced wavelengths in the near infrared part of the spectrum (700 to 1000 nm wavelengths).

The photo-detectors 95*a*, 95*b* generate electrical signals corresponding to the incident near infrared radiation intensities. These signals are digitized by an analog to digital conversion chip 97 and input to a microprocessor 98. The microprocessor 98 contains stored information concerning calibration constants of the detectors, optical fibers, and filters and converts the digital input into digital near-infrared light intensity values. The radiation intensity $I_{\lambda 1}=C_{\lambda 1}V_1$ where $V_1$ is the voltage on the first photo-diode and $C_1$ is a calibration constant for the combination of optical filters, diodes and electronic amplification circuits. The radiation intensity $I_{\lambda 2}=C_{\lambda 2}V_2$ where $V_2$ is the voltage on the second photo-diode and $C_{\lambda 2}$ is a calibration constant for the combination of optical filters, diodes and electronic amplification circuits. $C_{\lambda 1}$ and $C_{\lambda 2}$ which are stored in memory 98*a*. If at least 40% (or some number between 1% and 99%) of the source temperatures obtained from the 128 points are between 700 and 2500 K, then a frequency analysis is conducted as explained below. The near infrared intensities at the two wavelengths are sampled for a specific time-period and a series of digital radiation temperatures of the incident radiation field are calculated. For example, one could sample for 1 second at 128 Hz, store at least 128 data points for each photo-detector 95*a*, 95*b* and then store the sample or the temperature obtained from Eq. (2)) with store 98*a*. These temperatures and intensities are used to generate a probability density function and a power spectral density.

A record of the background intensities and power spectral densities is continuously generated and updated by the microprocessor 98 and compared with stored information retrieved from store 98*a* concerning corresponding values when radiation from a flame is incident on any one or more of the fiber doublets 91.

The average of the background intensities are also stored for ten seconds and at any particular sampling period of 1 sec, the intensities are stored after subtracting the average intensity obtained from 10 seconds before the current period. This allows a dynamic background intensity correction. The biggest advantage of this scheme is the variation in ambient radiation (such as bright sunny days or dark nights or brightly lit room etc.), does not affect the sensitivity of the detector 4 in any means.

The power spectral density describes how the variance of a random process is distributed with frequency. For an unsteady signal $I_\lambda(t)$ being sampled at a frequency of M (Hz), the noise normalized PSD $E_N$ at a frequency f, is defined as:

$$E_N(f) = \frac{\int_0^f E(f)df}{\int_0^f S(f)df}$$

where E(f) is the spectrum function for the signal $I_\lambda(t)$, divided by the mean square deviation of $I_\lambda$.

The spectrum function is the Fourier transform of the auto-correlation coefficient, R(t) and is given by:

$$E(f) = 2\int_{-\infty}^{+\infty} R(t)\exp(i2\pi\ \mathrm{ft})dt$$

where R(t), is the autocorrelation coefficient at two different times and is given by:

$$r_{xx}(\Delta t) = \frac{\sum_{i=1}^{N} x'(t)x'(t+\Delta t)}{\overline{x'^2}}$$

-continued $$R(\Delta t) = \frac{\sum_{i=1}^{N} I'(t)I'(t+\Delta t)}{\bar{I}'^2}$$

This spectrum function can be obtained by standard FFT, commercial FFT subroutines such as ISML, MatLab, or commercial FFT hardware, wavelet analyses or other suitable means. S(f) is the spectrum function for white noise, which when sampled at a frequency of M (and low pass filtered at M/2), has a uniform value 2/M between 0 and M/2 and is 0 at other frequencies. I' is the fluctuation of $I_1$ from its mean value obtained from all data points.

Physically, the normalized PSD at any frequency represents the ratio of the total energy of the signal below that frequency in comparison with a white noise source sampled with the same temporal resolution. The area under the power spectral density curve for any frequency range is proportional to the energy of the instantaneous fluctuations of the signal from its mean value. Fire is detected if the noise normalized area under the frequency spectrum curve is greater than 1.5 at a frequency (f) which could be from 5 to 20 Hz.

One can also obtain ratioed power spectral density (ER) which is defined as:

$$E_R(f) = \frac{\int_{f_{1L}}^{f_{1H}} E(f)df}{\int_{f_{2L}}^{f_{2H}} E(f)df}$$

where $f_{1L}$ is a first lower frequency ranging from 0 to 50 Hz, $f_{1H}$ is a first higher frequency greater than $f_{1L}$, $f_{2L}$ is second lower frequency ranging from 0 to 50 Hz, and , $f_{2H}$ is a second higher frequency greater than $f_{2L}$. Physically, this represents that the total power in one band of frequencies is compared with the total power in another band of frequencies.

Power spectral density of noise normalizes the incident power spectral density before comparison. The microprocessor therefore knows the probability density function signatures and noise normalized power spectral density signatures of standard fires in the first instance.

The microprocessor 98 evaluates a detected flame based on incident radiation therefrom. The distance of a flame from the detector 900 does not restrict the detection, because source temperature rather than the intensity of the source is the detection criterion. This noise normalized power spectral density check allows the invention to discriminate between a non-fire radiation source and a fire.

Figure 13:
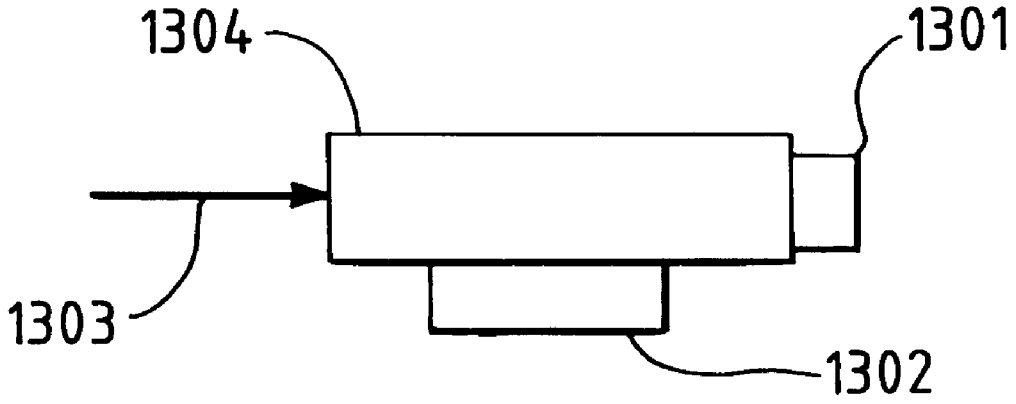
FIG. 13 is a block diagram of a smoke detector in accordance with the invention.

For detection of slow smoldering fires and smoke, as well as for compliance with current building codes, the present invention contemplates separate smoke detection channels. As shown in FIG. 13, the transmittance (extinction) of light across a smoke chamber 1304 of length L is given by:

$$t=I/I_o$$

where I is voltage on the transmission detector 1301 and $I_o$ is the voltage when there is no smoke (obtained from 10 seconds earlier).

$$s=KV$$

where K is a calibration constant (such as using a known optical arrangement or a standard reference material such as polystyrene bead or alcohol droplets from a monodisperse generator (not shown)) and V is the voltage on the scattering detector 1302. Detector 1302 can either have a wide angle or a narrow angle view, as desired.

Parameter (s/t) is the scattering to extinction ratio and provides information on the optical characteristics of soot produced from fires. Therefore if this parameter falls within 0.2 and 0.3, then the scattering to extinction ratio is typical of soot formed by hydrocarbon combustion. If this falls within 0.7 and 0.9, then it is representative of particulates formed from the combustion of silicone fuels. The smoke detection cell 99 responds to light absorption or scattering of impinging light on the detector as discussed below.

As shown in FIG. 9, light-sensing optical fiber 99*c* receives light-pulses from light emitting diode 105 (FIGS. 9, 10) serving as a scattered light detector reference. The pulses are at a very high frequency to avoid any interference with the noise-normalized power spectral density of radiation monitored by the flame sensor 90. A portion of these light pulses is scattered when there is smoke entering into chamber 99 through apertures 102B (FIG. 9*a*). Correspondingly, the light intensity level received by the scatter channel fiber 99*a* increases. This scattered light information is relayed to the photodiodes 95*a* or 95*b* by optical fiber 99*a*.

Simultaneously, light sensing optical fibers 99*b* receive light pulses from the LED 105 (FIG. 10), as light absorption signals. A portion of these light pulses are absorbed when there is smoke in chamber 99. Pulses emanating from fiber 99*a*, 99*b* are amplified by op/amps 104*a* and routed to the microprocessor 98. The microprocessor 98 makes a comparison of the scattered light sensed by the fibers 99*a*, and the absorbed light sensed by fibers 99*b* at a high frequency without interfering with the low frequency flame detection channels described earlier. The microprocessor 98 is thus enabled to determine if smoke is present. The present invention contemplates usage of inexpensive, readily available acrylic fiber optic (such as that manufactured by 3M Corporation) to serve as light sensing fibers 99*a–c*. View angles approaching 360 degrees utilizing optic fiber can be attained.

The microprocessor 98 compares the intensities on the scattering and absorption channels to estimate the size and concentration of associated particulate. Such a check eliminates false alarms by dust and smog.

The presence of smoke by itself could be used to sound an alarm and/or send the appropriate output signal via a sounding device 100 or to an external alarm 901. Presence of smoke in addition to that of flame is the alarm criterion in some areas (open kitchen, room with a fireplace), where a flame is expected. Any logical combination of the results of the flame plus smoke detection scheme in accordance with the present invention can be programmed into the microprocessor depending on the application, as one of ordinary skill can readily appreciate. The detector unit 900 can be housed in a suitable box 101 with a cover 102 (FIGS. 9*a*, 9*b*, 10). An indicator 96 (FIGS. 9, 9*a, b*) can be provided to show when the detector 900 is operational. The indicator 96 can take the form of a panel light, LED, or similar apparatus as one of ordinary skill can appreciate.

Use of these novel concepts and these inventive processes simultaneously for detecting fires using affordable infrared optics, while avoiding false alarms with unique discriminating algorithms is one provision of the present invention. As mentioned previously, use of readily available plastic fiber optic as a sensing means is another novel aspect. The smoke detection and discrimination method is enabled because fire-generated smoke has unique particulate size distribution and optical properties that can be examined using near-infrared optics. The flame detection method is enabled due to the fact that common household and automotive fires have two unique characteristics: (1) source temperature probability distribution function, and (2) noise-normalized power spectral density.

Figure 11:
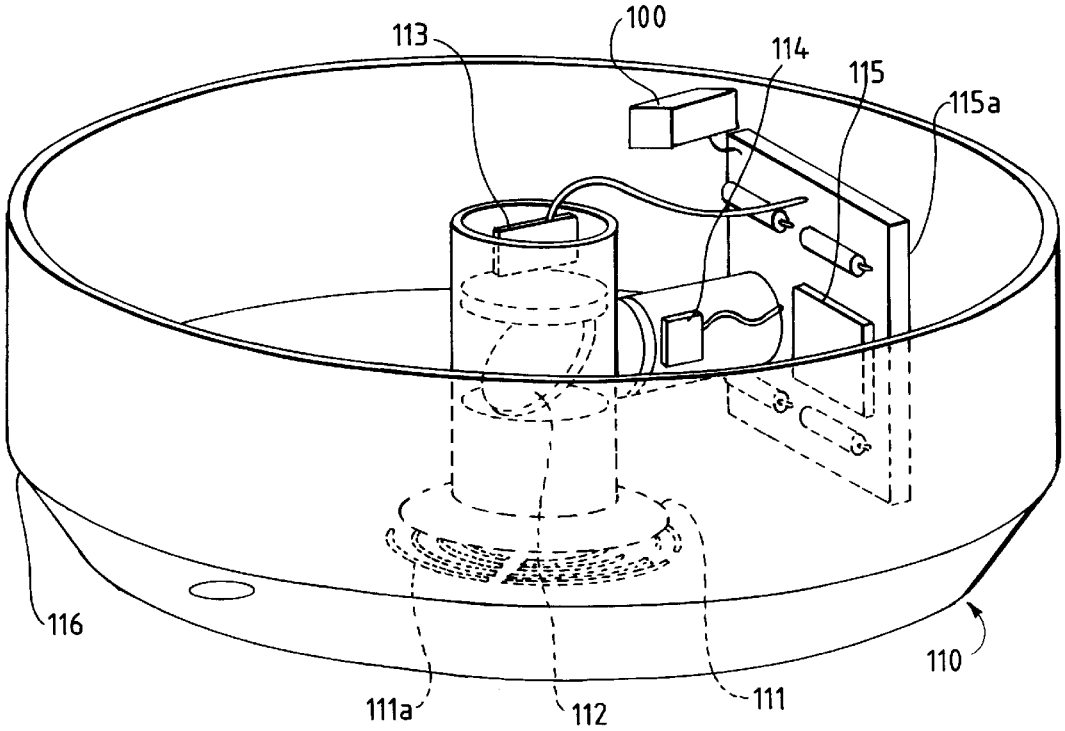
FIG. 11 is an interior perspective view of an alternate embodiment of the fire and smoke detector of the present invention.

FIG. 11 shows an alternate embodiment of the invention that does not rely on the use of fiber optics for light transmission. This embodiment 110 uses a fish-eye lens 111 and a beam splitter 112 instead of the fiber optics hereinbefore described. Instead of a fish eyes lens, any number of wide angle, ultra wide angle or similar optic apparatus could be utilized. The present invention therefore need not be restricted to an embodiment that uses fiber optics.

The embodiment of FIG. 11 includes a suitable housing 116 carrying a printed circuit board 115 with a digital signal processor (DSP) 115 operatively connected to a first detector 113 for a first wavelength, and a second detector 114 for a second wavelength. The DSP 115 could have an inboard A/D connector or an outboard A/D connector, as one of ordinary skill can easily contemplate.

Light entering the housing through apertures 111*a* strike the fish-eye lens 111 which passes the light to a beam splitter 112 which splits the light into two paths for transmission to first and second detectors 113 and 114. The detectors 113 and 114 relay the light information to the DSP 115 for suitable processing and if an alarm condition is found, DSP115 activates sounding device 100 accordingly.

Those who are skilled in the art will readily perceive how to modify the invention. Therefore, the appended claims are to be construed to cover all equivalent structures which fall within the true scope and spirit of the invention.

What is claimed is:

1. A smoke and flame detector comprising:

first and second photo-detectors operational within a near-infrared spectrum;

first and second optical filter means coupled to said first and second photo-detectors respectively;

an analog to digital (A/D) converter operatively coupled to said photo-detectors;

a microprocessor operatively coupled to said A/D converter wherein said microprocessor further comprises light intensity value conversion and sampling means for converting light intensity input from said A/D converter to values in a near-infrared spectrum range and sampling said values for a predetermined period;

memory means for storing information, said memory means coupled to said microprocessor and said A/D connector, wherein said memory means stores intensity values obtained from a predetermined sampling period and said detector utilizes said stored values to determine temperature PDF and noise normalized power special density;

first and second photo-diodes;

a digital to analog (D/A) converter operatively coupled to said photo-diodes;

said microprocessor operatively coupled to said first and second photo-diodes and said D/A converter;

a plurality of light sensing means for receiving light from at least one of said first and second diodes and passing the received light to said microprocessor;

at least one of said light sensing means comprising a light absorption detection means for providing information to said microprocessor relating to the intensity of received light;

at least another of said light sensing means comprising a scattered light detection means coupled to said microprocessor for receiving scattered light and passing the received scattered light to said microprocessor;

wherein each said photo-detector, photo diode, light sensing means, and optical filter means comprises a calibration constant; and wherein a noise normalized ration $E_N(f)$ output is calculated using:

$$E_N(f) = \frac{\int_0^F E(f)df}{\int_0^F S(f)df}$$

where E(f) is the power spectral density of voltage, intensity, or temperature, and S(f) is the power spectral density of random noise which is constant for a fixed sampling frequency.

2. The smoke and flame detector of claim 1 wherein at least one of said light absorption detector means and said scattered light detection means comprises an optic lens.

3. The smoke and flame detector of claim 1, wherein at least one said light sensing means comprises optic fiber.

4. The smoke and flame detector of claim 3, wherein said optic fiber is comprised of plastic.

5. The smoke and flame detector of claim 4 wherein said optic fiber is comprised of plastic.

6. The smoke and flame detector of claim 1 wherein said scattered light detection means comprises optic fiber.

7. The smoke and flame detector of claim 6 wherein said optic fiber is comprised of plastic.

8. The smoke and flame detector of claim 1 wherein said light absorption detection means comprises optic fiber.

9. The flame and smoke detector of claim 1, wherein said storage means comprises information relating to said calibration constants.

10. The flame and smoke detector of claim 1, wherein said microprocessor, utilizing said stored intensity values calculates an incident radiation field in accordance with a detected radiation intensity $I_{\lambda 1}=C_{11}V_1$ where $V_1$ is the voltage on the first photo-diode and $C_{11}$ is said calibration constant and wherein a detected radiation intensity $I_{\lambda 2}=C_{12}V_2$ where $V_2$ is the voltage on the second photo-diode and $C_{12}$ is a calibration constant.

11. The flame and smoke detector of claim 10, wherein said microprocessor determines a probability density of a flame source temperature over a plurality of sample points in accordance with $$T=KI_{\lambda 1}/I_{\lambda 2} \text{ for each said sample point.}$$

where T is the temperature, K is a calibration constant and $I_{\lambda 1}$ and $I_{\lambda 2}$ represent intensities recorded.

12. The flame and smoke detector of claim 11, wherein said determined temperature is stored in said memory means.

13. The flame and smoke detector of claim 11, wherein at least one of said temperature sample points falls within a range of temperatures that ranges between approximately 700K and 2500K.

14. The flame detector of claim 1, further comprising a low pass filter, whereby said white noise is low pass filtered at a frequency of M/2.

15. The flame detector of claim 14, wherein said low pass filtered white noise comprises a uniform value 2/M between zero and M/2, and said value is approximately zero at other frequencies.

16. A flame detector of claim 1 wherein a fixed level of $E_N(f)$ is used to indicate the existence of a fire.

17. The flame detector of claim 1 wherein a ratioed power spectral density $E_R(f)$ is calculated in accordance with $$E_R(f) = \frac{\int_{f_{1L}}^{f_{1H}} E(f)df}{\int_{f_{2L}}^{f_{2H}} E(f)df}$$

where $f_{1L}$ is a first lower frequency ranging from 0 to 50 Hz, $f_{1H}$ is a first higher frequency greater than $f_{1L}$, $f_{2L}$ is second lower frequency ranging from 0 to 50 Hz, and, $f_{2H}$ is a second higher frequency greater than $f_{2L}$.

18. The flame detector of claim 17 wherein the value of $E_R(f)$ indicates the existence of a fire.

19. A method of detecting a flame comprising the steps of:

recording the level of background radiation; detecting at least one source of radiation having a frequency within the near infrared spectrum;

sampling the detected radiation for a predetermined period;

calculating a series of radiation temperatures in real time to determine an incident radiation field;

generating a probability density function (PDF) for one of an incident radiation field, a temperature and a voltage level;

calculating a power density for said PDF comparing the recorded background radiation with the calculated power density to yield a value; and providing an alarm indication when said value exceeds a predetermined level.

* * * * *